US007401882B2

(12) United States Patent
Umezawa

(10) Patent No.: US 7,401,882 B2
(45) Date of Patent: Jul. 22, 2008

(54) PRINTING APPARATUS AND METHOD OF CONTROLLING PRINTING THEREIN

(75) Inventor: Masahiko Umezawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 203 days.

(21) Appl. No.: 11/276,194

(22) Filed: Feb. 17, 2006

(65) Prior Publication Data

US 2006/0192807 A1 Aug. 31, 2006

(30) Foreign Application Priority Data

Feb. 25, 2005 (JP) ..... 2005-051371

(51) Int. Cl.
*B41J 29/393* (2006.01)

(52) U.S. Cl. ..... 347/19

(58) Field of Classification Search ..... 347/19
See application file for complete search history.

(56) References Cited

U.S. PATENT DOCUMENTS

| | | | | |
|---|---|---|---|---|
| 5,896,146 | A | 4/1999 | Murata et al. | |
| 6,661,532 | B2 | 12/2003 | Umezawa et al. | |
| 6,969,155 | B2 | 11/2005 | Umezawa | |
| 6,974,201 | B2 * | 12/2005 | Kanemura | 347/23 |
| 7,207,644 | B2 * | 4/2007 | Kaburagi | 347/19 |

FOREIGN PATENT DOCUMENTS

| | | |
|---|---|---|
| EP | 750988 A2 * | 1/1997 |
| JP | 58-5280 | 1/1983 |
| JP | 9-11463 | 1/1997 |
| JP | 9-11504 | 1/1997 |

* cited by examiner

*Primary Examiner*—Matthew Luu
*Assistant Examiner*—Justin Seo
(74) *Attorney, Agent, or Firm*—Fitzpatrick, Cella, Harper & Scinto

(57) ABSTRACT

A printing apparatus prints by causing a carriage, on which is mounted a printhead having a plurality of printing elements, to scan across a printing medium, the plurality of printing elements being divided into a plurality of blocks based upon entered print data. The apparatus includes a first comparison circuit for performing a comparison to determine whether a number of printing elements driven simultaneously in the blocks exceeds a first reference threshold; a second comparison circuit for performing a comparison to determine whether a number of times continuous drive of the simultaneously driven printing elements has been performed exceeds a second reference threshold; and a generating circuit which if a result of comparison by the first comparison circuit exceeds the first reference threshold and a result of comparison by the second comparison circuit exceeds the second reference threshold, adds reference pulse data and corrected pulse data to thereby generate driving pulses of corrected pulse width.

8 Claims, 9 Drawing Sheets

FIG. 3D

| COUNTER VALUE | CORRECTION VALUE |
|---|---|
| CT1 | CORRECTION VALUE 1 |
| CT2 | CORRECTION VALUE 2 |
| CT3 | CORRECTION VALUE 3 |
| ⋮ | ⋮ |

PRINTING APPARATUS AND METHOD OF CONTROLLING PRINTING THEREIN

FIELD OF THE INVENTION

This invention relates to a printing apparatus and printing control method. More particularly, the invention relates to a printing apparatus and printing control method in which a printhead having a plurality of printing elements is divided into a plurality of blocks each of which includes a prescribed number of printing elements, and the plurality of blocks are driven sequentially within an ink discharge period that conforms to the resolution of an image to be printed, thereby discharging the ink to form the image.

BACKGROUND OF THE INVENTION

A large number of printers have come into use in recent years and these printers are required to print at high speed and high resolution and with little noise. A printing apparatus that employs the ink-jet printing method (such an apparatus will be referred to as an "ink-jet printing apparatus" below) is an example of printing technology that meets these requirements. An ink-jet printing apparatus is capable of printing on a printing medium in non-contact fashion since it prints on the medium by discharging ink from nozzles provided on a printhead. As a result, a printing image can be formed stably on a wide variety of printing media.

Among these types of ink-jet printing apparatus, those that employ a method of printing by forming ink droplets using utilizing thermal energy are particularly simple in structure and therefore are advantageous in that the nozzles that discharge the ink can readily be packed close together at a high density.

In an ink-jet printing apparatus, however, stable discharge of the ink is required in order to perform printing by discharging ink from the printhead. In other words, it is required that the printhead of the ink-jet printing apparatus be durable and that it exhibit stable performance with respect to temperature fluctuation of the printhead and number of simultaneous discharges of the ink. Stable performance means that the amount of ink discharge, the discharge speed and the discharge precision (precision of the position at which ink is discharged) not vary according to conditions, such as a fluctuation in the temperature of the printhead.

Accordingly, in order to assure stable performance, printhead control in which driving pulses applied to the printhead are varied depending upon the temperature of the printer apparatus per se or the temperature of the printhead has been contemplated. In accordance with this conventional technique, the number of printing elements driven simultaneously varies depending upon the image to be printed and therefore the voltage supplied to the printing apparatus per se from the power supply also varies. As a consequence, there is a great change in voltage drop ascribable to the resistance of the wiring connecting the printing apparatus and the printhead. If a constant voltage is being impressed upon the printhead, the voltage applied to the printing elements within the printhead will differ for every image printed.

By way of example, in the case of an ordinary ink-jet printing apparatus, the wiring resistance between the printing apparatus per se and the printhead is on the order of 0.2 Ω, the head-contact resistance is on the order of 0.1 Ω and therefore the overall resistance is on the order of 0.3 Ω. If it is assumed that a driving current of 100 to 200 mA flows per printing element and that 54 printing elements are driven simultaneously, then the total current will be 5.4 to 10.8 A and the voltage drop due to the wiring will be 0.3 Ω×(5.4 to 10.8 A)=1.62 to 3.24 V. This is the voltage fluctuation to which the printing elements are subjected.

A fluctuation in the voltage impressed upon the printing elements leads to a fluctuation in discharge energy, namely a fluctuation in the discharge speed of the ink. Further, although the voltage impressed upon the printing elements provided in each of the nozzles of the printhead differs owing to simultaneous discharge of the ink, the driving voltage and driving pulses are decided in such a manner that the ink will be discharged stably when the number of simultaneous discharges is largest, i.e., when the driving voltage is greatest. When the number of simultaneous discharges is small, therefore, the printing elements are subjected to an excessively large driving voltage or driving pulses. This leads to a decline in the durability of the printhead.

In order to solve these problems, a thermal dot printing apparatus in which the driving pulse or driving time is changed in dependence upon the number of printing elements driven simultaneously has been proposed (e.g., see the specification of Japanese Patent Application Laid-Open No. 58-5280).

There has also been proposed an ink-jet printing apparatus in which an image signal transferred from a host device or the like is held temporarily in a buffer, the image signal is converted by an image processing circuit to a bit signal for every heating resistor within the ink-jet printhead, and the driving-pulse conditions are decided using a look-up table on the basis of the number of nozzles that discharge ink, the positions of these nozzles and temperature information obtained from a thermister provided in the ink-jet printhead (e.g., see the specification of Japanese Patent Application Laid-Open No. 9-11463).

According to yet another proposed ink-jet printing apparatus, the number of printhead nozzles to be driven simultaneously is counted before the printing of one scanning line, and a driving parameter is stored in a RAM and used based upon the value of the count (e.g., see the specification of Japanese Patent Application Laid-Open No. 9-11504).

In the examples of the prior art described above, however, the value of the voltage at the power-supply terminal of the printhead cannot be determined accurately merely by the voltage drop produced in accordance with the number of printing elements driven simultaneously. More specifically, if 56 printing elements are driven continuously as the maximum number of simultaneously driven elements, the driving voltage of the printhead will decline gradually. The amount of this voltage drop is not reflected in the driving pulse width decided by the number of simultaneously driven elements. The reason for this is that the supply capability of the power supply means that supplies the driving current to the printhead declines owing to continuous supply of large current.

FIGS. 4A and 4B are diagrams illustrating voltage drop due to number of printing elements driven simultaneously. A waveform 401 shown in FIG. 4A is a waveform of voltage fluctuation when 18 printing elements are driven simultaneously, and a waveform 402 shown in FIG. 4B is a waveform of voltage fluctuation when the maximum of 56 printing elements are driven simultaneously. A voltage drop VH_d2 indicated by waveform 402 is approximately three times larger than a voltage drop VH_d1 indicated by waveform 401.

FIGS. 5A and 5B are diagrams illustrating the states of voltage drop in an instance where the driving states shown in FIGS. 4A and 4B are allowed to continue. A waveform 501 shown in FIG. 5A illustrates the state of voltage fluctuation in a case where 18 simultaneously driven printing elements are driven continuously, and a waveform 502 shown in FIG. 5B illustrates the state of voltage fluctuation in a case where 56 simultaneously driven printing elements are driven continuously.

The waveform 501 shown in FIG. 5A indicates that the voltage drop remains at VH_d1 even upon elapse of a continuous driving time T1. On the other hand, in the case of waveform 502 in FIG. 5B, the amount of voltage drop increases with the passage of time when 56 simultaneously driven printing elements are driven continuously, with a voltage drop of VH_d3 being produced at continuous driving time T2 as the amount of fluctuation in voltage drop. As a result, the actual amount of voltage drop at time T2 is VH_d2+VH_d3.

Conceivable methods of preventing the occurrence of the fluctuation VH_d3 in voltage drop in continuous drive include (1) enlarging the capability of the power supply means that supplies the printing apparatus with power, and (2) providing large-capacity charge storing means between the power supply means and printhead to compensate for the fluctuation in voltage drop using the accumulated electric charge. However, both of these expedients raise cost and increase the size of the printing apparatus.

SUMMARY OF THE INVENTION

Accordingly, the present invention has been proposed to solve the problems encountered in the prior art and can provide a printing apparatus and printing control method whereby even if the voltage that drives a printhead gradually declines owing to continuous driving of a large number of printing elements, driving pulses for achieving stable drive of the printing elements are supplied so that the printing of excellent images is made possible even though the voltage that drives the printhead fluctuates.

The present invention provides a printing apparatus for printing by causing a carriage, on which is mounted a printhead having a plurality of printing elements, to scan across a printing medium, the plurality of printing elements being divided into a plurality of blocks based upon entered print data, the apparatus comprising:

first comparison means for performing a comparison to determine whether a number of printing elements driven simultaneously in the blocks exceeds a first reference threshold;

second comparison means for performing a comparison to determine whether number of times continuous drive of the simultaneously driven printing elements has been performed exceeds a second reference threshold of number of times such drive is performed; and generating means which, if result of comparison by the first comparison means exceeds the first reference threshold and result of comparison by the second comparison means exceeds the second reference threshold, is for adding reference pulse data and corrected pulse data to thereby generate driving pulses of corrected pulse width.

Further, the present invention provides a method of controlling printing in a printing apparatus for printing by causing a carriage, on which is mounted a printhead having a plurality of printing elements, to scan across a printing medium, the plurality of printing elements being divided into a plurality of blocks based upon entered print data, the method comprising:

a first comparison step of performing a comparison to determine whether a number of printing elements driven simultaneously in the blocks exceeds a first reference threshold;

a second comparison step of performing a comparison to determine whether number of times continuous drive of the simultaneously driven printing elements has been performed exceeds a second reference threshold of number of times such drive is performed; and a generating step of adding reference pulse data and corrected pulse data to thereby generate driving pulses of corrected pulse width if result of comparison at the first comparison step exceeds the first reference threshold and result of comparison at the second comparison step exceeds the second reference threshold.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate an embodiment of the invention and, together with the description, serve to explain the principles of the invention.

FIG. 3D is a diagram illustrating a state in which first, second and third correction values corresponding to respective ones of count values have been stored in a register;

DETAILED DESCRIPTION OF THE PREFERRED EMBODIMENT

Preferred embodiments of the present invention will now be described in detail with reference to the accompanying drawings.

Figure 1:
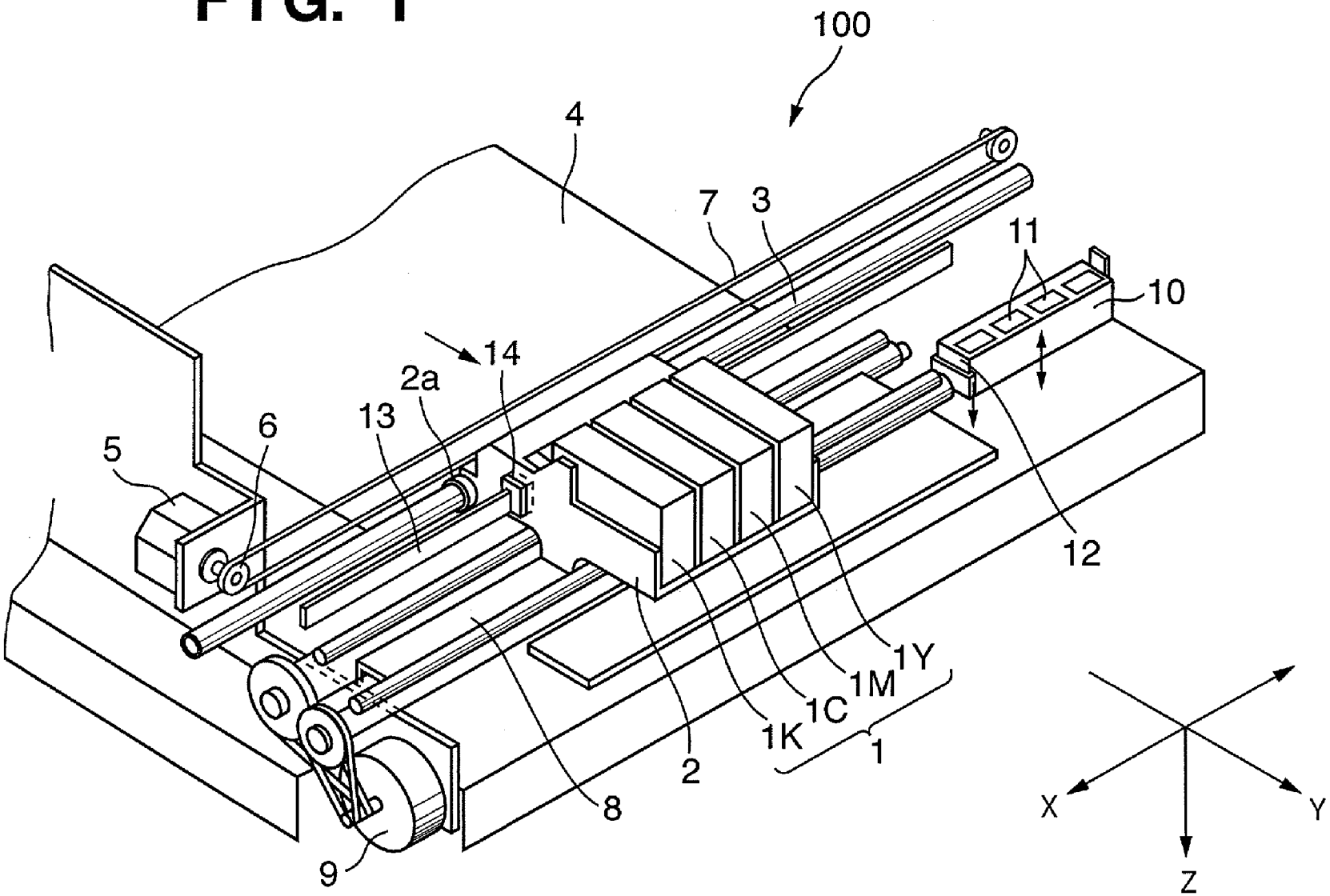
FIG. 1 is a perspective view of the external appearance of a printing apparatus according to an embodiment of the present invention.

FIG. 1 is a perspective view of the external appearance of a printing apparatus 100 according to an embodiment of the present invention. The printing apparatus 100 has a printhead 1 that supports the ink-jet printing method. The printhead 1 prints on a printing medium using a method in which the ink contained in ink tanks mounted on the printhead 1 is heated using electrothermal transducers (referred to as "printing elements" below) such as heating elements having heating resistors as energy generating means, thereby causing the ink to be discharged by thermal energy. A high-density, high-definition is achieved by this method. The printhead 1 has four ink tanks containing inks of four colors, namely a cyan ink tank 1C, a magenta ink tank 1M, a yellow ink tank 1Y and a black ink tank 1K. The printhead 1 and each of the ink tanks 1C, 1B, 1Y, 1K are mounted on a carriage 2 in a state in which they are arrayed along the length direction of a guide shaft 3 (a direction that corresponds to the X direction in FIG. 1, this direction being referred to as the "main-scan direction" below), namely along the traveling direction (main-scan direction) of the carriage 2.

The printhead 1 is mounted on the carriage 2 in an attitude in which it discharges ink downward (along the Z direction) in FIG. 1. Ink droplets are discharged while a bearing 2*a* of the carriage 2 moves along the guide shaft 3, thereby forming one scan of an image on a printing medium 4 such as printing paper. The carriage 2 moves back and forth along the guide shaft 3 via a timing belt 7 owing to rotation of a pulley 6 to which the driving force of a carriage motor 5 is transmitted.

An image is formed on the printing medium 4 by transporting the printing medium 4 along the Y direction (referred to as the "sub-scan direction" below) at a prescribed timing in sync with the movement of the carriage 2 along the main-scan direction. For example, when one scan of printing by the printhead 1 ends, the printhead 1 suspends printing and a transport motor 9 is driven to transport the printing medium 4, which is situated on a platen 8, a prescribed amount along the sub-scan direction perpendicular to the traveling direction (main-scan direction) of the carriage 2. The next scan of image formation is performed while the carriage 2 is moved along the guide shaft 3. The image is formed on the printing medium 4 by repeating these operations.

A recovery unit 10 performs a recovery operation in order to maintain the printhead 1 in an excellent ink discharging state. The recovery unit 10 is provided with caps 11 for capping the nozzle surface of the printhead 1 in the halted state, a wiper 12 for wiping off the ink discharge surface of the printhead 1, and a suction pump (not shown) for sucking ink from the ink discharge nozzles of the printhead 1.

Further, the printing apparatus 100 is equipped with an encoder scale 13 and encoder 14 and is capable of obtaining position information and velocity information of the carriage 2 based upon detection information from the scale and encoder. The position information and velocity information is fed back for control of the carriage motor 5 when the carriage 2 is driven along the main-scan direction. Ink discharge timing in the printhead 1 is determined based upon the position information.

A control mechanism for executing control of printing by the above-described apparatus will now be described.

Figure 2:
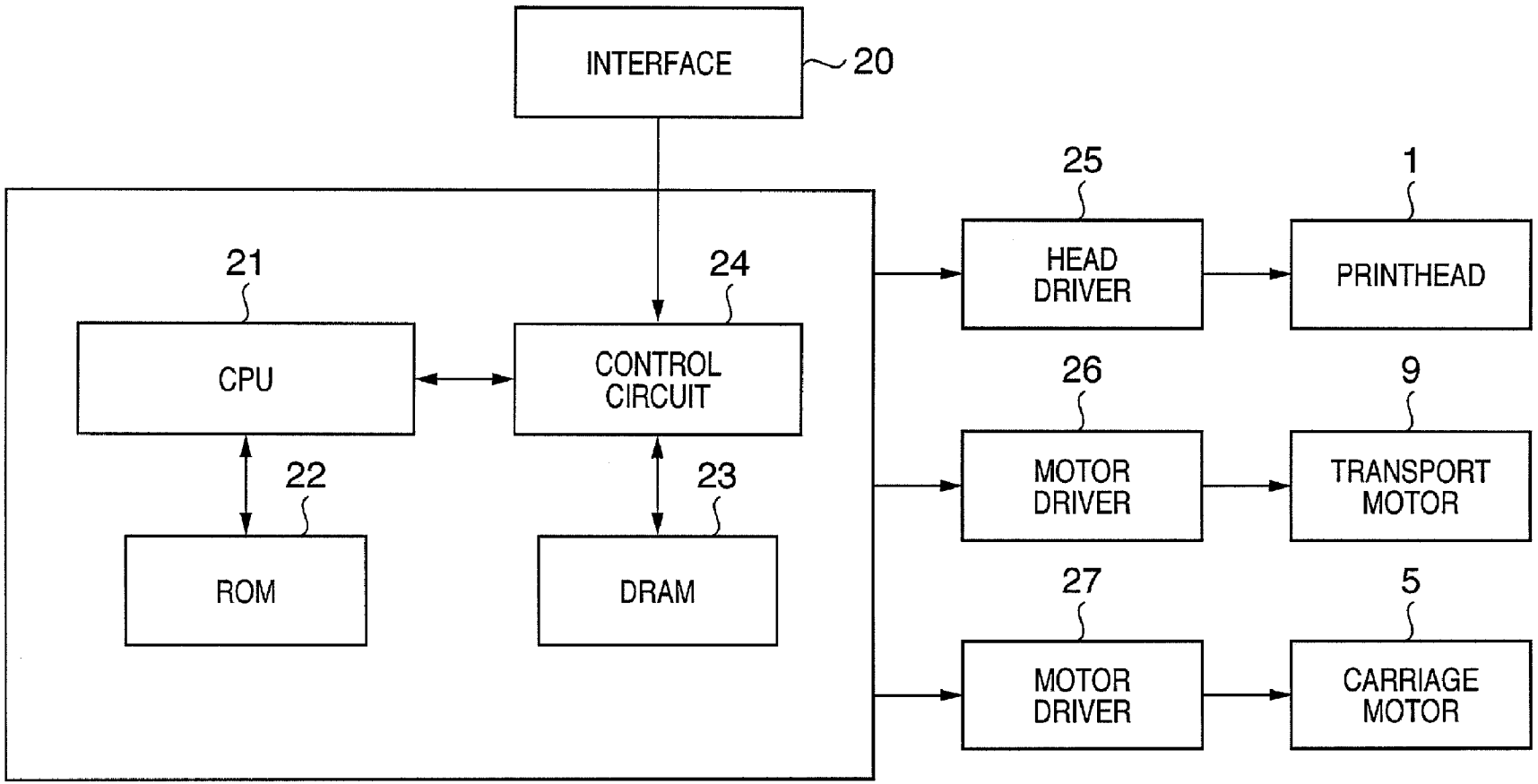
FIG. 2 is a block diagram illustrating a circuit arrangement for driving a printing apparatus.

FIG. 2 is a block diagram illustrating a circuit arrangement for driving the printing apparatus 100. In FIG. 2 of the control circuitry, a print signal and print data are input from an interface 20. The circuitry further includes a CPU 21, a ROM 22 storing a control program executed by the CPU 21, and a DRAM 23 for storing various data (the print signal and print data, which is supplied to the printhead). A control circuit 24 supplies print data to the printhead 1 and controls the print data. The control circuit 24 also controls the transfer of data among the interface 20, CPU 21 and DRAM 23. The structure and the flow of processing of the control circuit 24 will be described in detail with reference to FIGS. 3A and 3B.

The carriage motor 5 in FIG. 2 transports the printhead 1 and the transport motor 9 transports the printing medium. A head driver 25 drives the printhead 1, and motor drivers 26 and 27 drive the transport motor 9 and carriage motor 5, respectively.

In terms of operation, the motor drivers 26, 27 are driven under the overall control of the CPU 21 and control circuit 24 based upon print data that has entered via the interface 20. The printhead 1 is driven and printing performed in accordance with the print data sent to the head driver 25. Although it is assumed here that the control program executed by the CPU 21 is stored in the ROM 22, it can also be so arranged that a storage medium such as an EEPROM capable of being erased and written is further provided and the control program modified from a host computer connected to the printing apparatus 100.

Figure 3A:
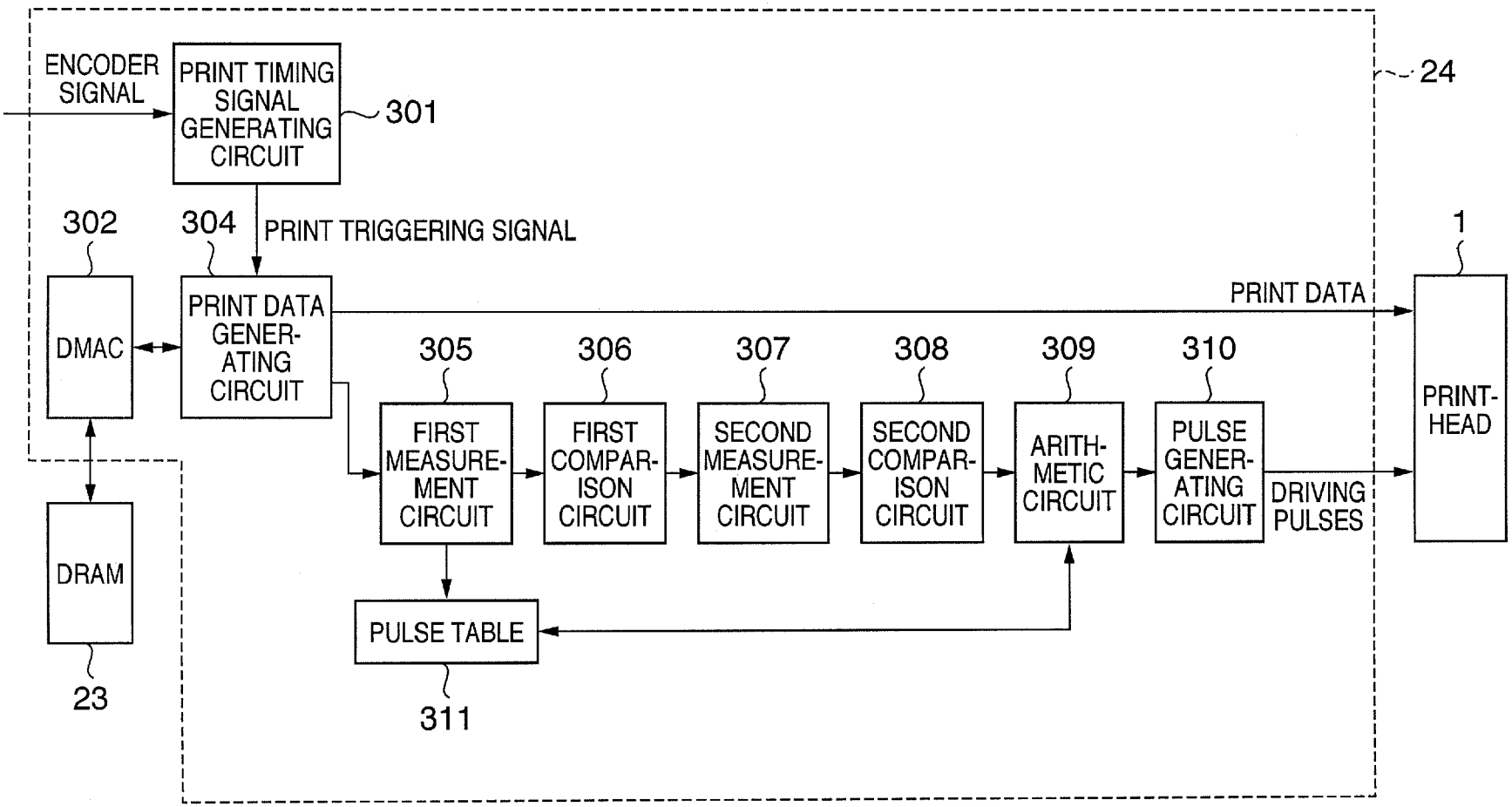
FIG. 3A is a block diagram illustrating in detail the structure of a control circuit in FIG. 2.
Figure 3B:
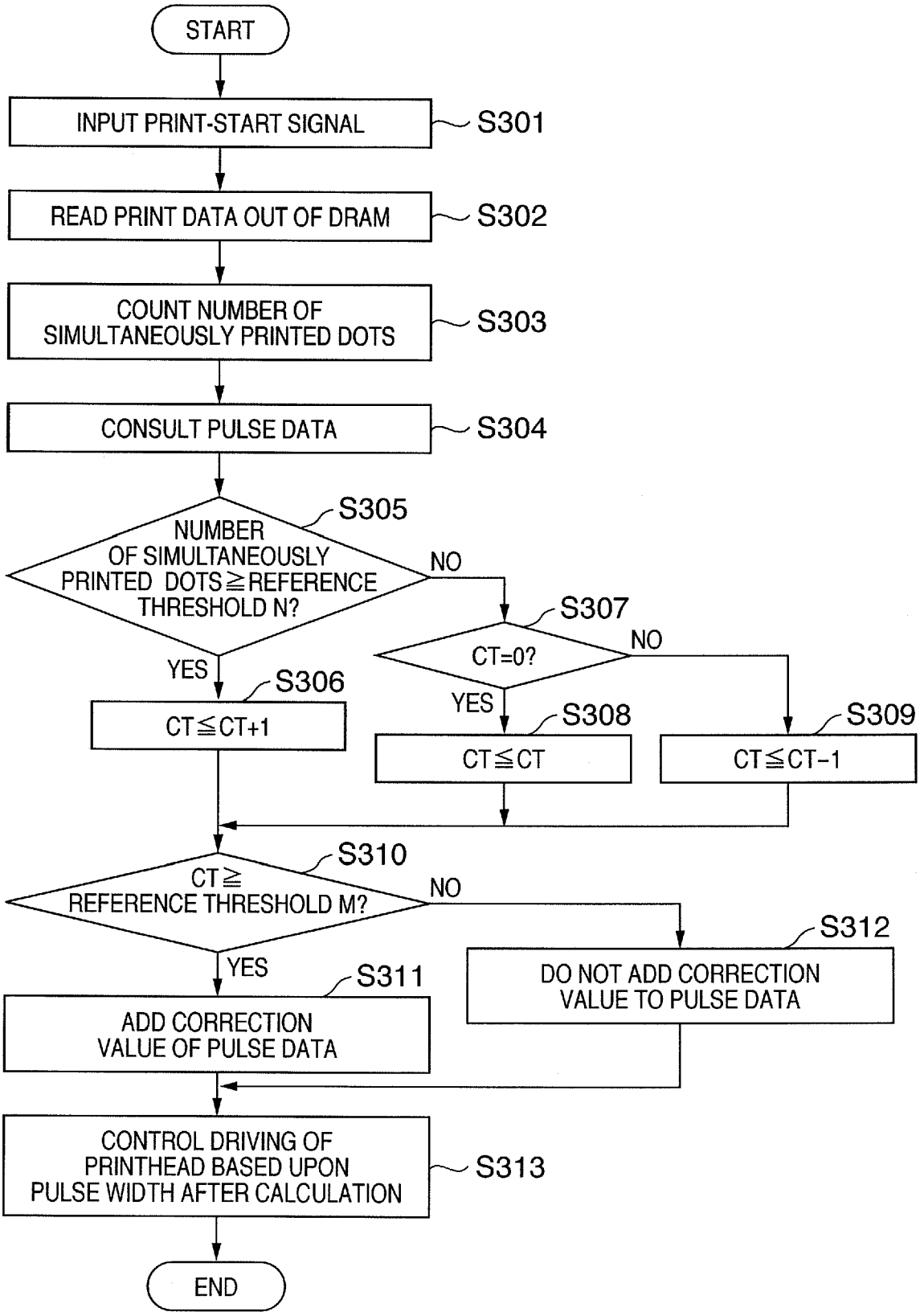
FIG. 3B is a flowchart useful in describing in detail the flow of control in the control circuit.

FIG. 3A is a block diagram illustrating in detail the structure of the control circuit 24 of FIG. 2, and FIG. 3B is a flowchart useful in describing the flow of control in the control circuit 24.

The control circuit 24 receives print data, which has been transmitted from an external device, via the interface 20 and stores the print data in the DRAM 23.

Based upon a signal that has entered from the color correcting circuit 31, a print timing signal generating circuit 301 generates a print triggering signal, which is a triggering signal that initiates printing, and transfers the signal to a print data generating circuit 304 (step S301). The print timing signal generating circuit 301 generates the print triggering signal at a timing that conforms to the printing resolution. For example, if the printing resolution is 1200 dpi, then the print timing signal generating circuit 301 generates the print triggering signal every 1200 dpi.

Using the printing trigger of the entered print trigger signal, the print data generating circuit 304 reads print data out of the DRAM 23 via a DMAC 302 in first-in, first-out fashion (S302) and inputs the read-out print data to a first measurement circuit 305.

The first measurement circuit 305 expands the read-out data as print data made to conform to the structure of the printhead 1. At this time the number of dots printed simultaneously (which corresponds to the number of printing elements driven simultaneously) is counted as the number of nozzles of printhead 1 driven simultaneously (S303).

Figure 3C:
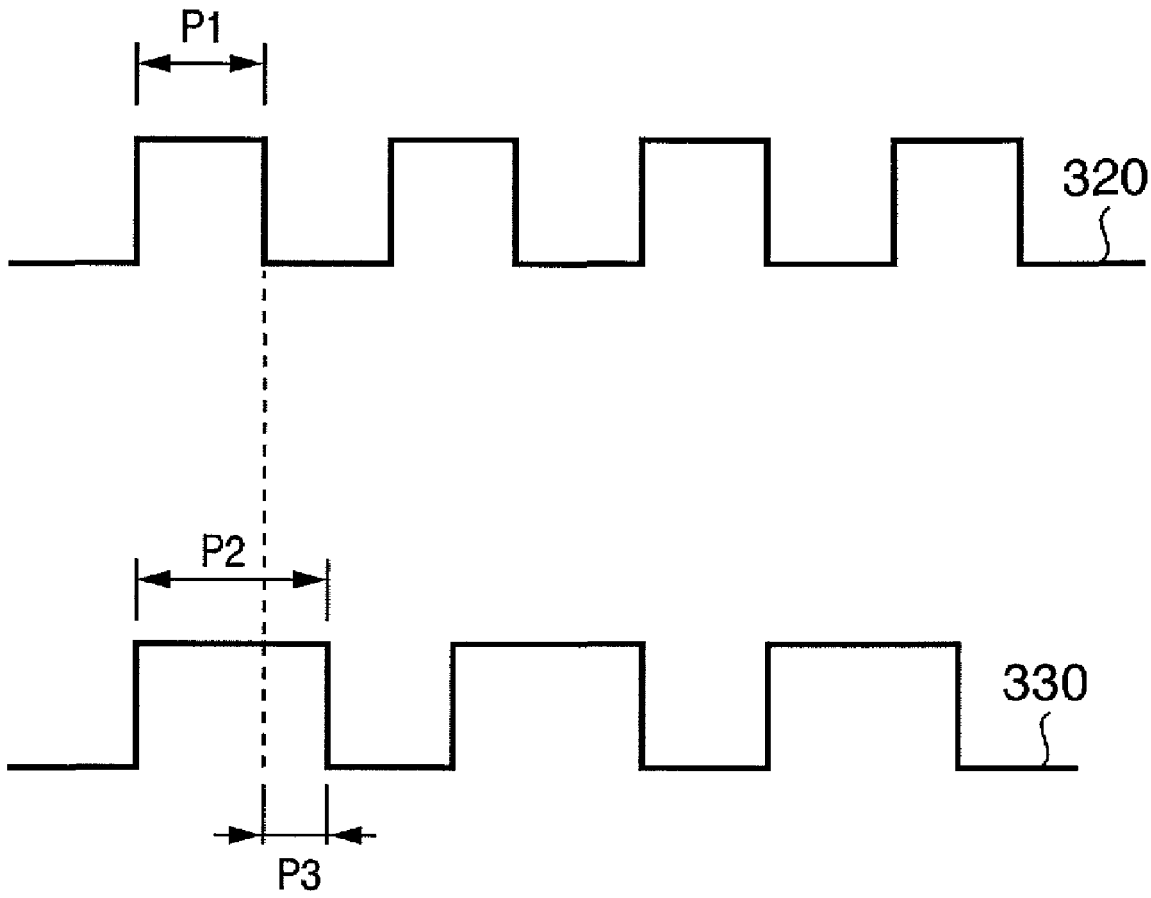
FIG. 3C is a diagram useful in describing correction pulse data.
Figure 3E:
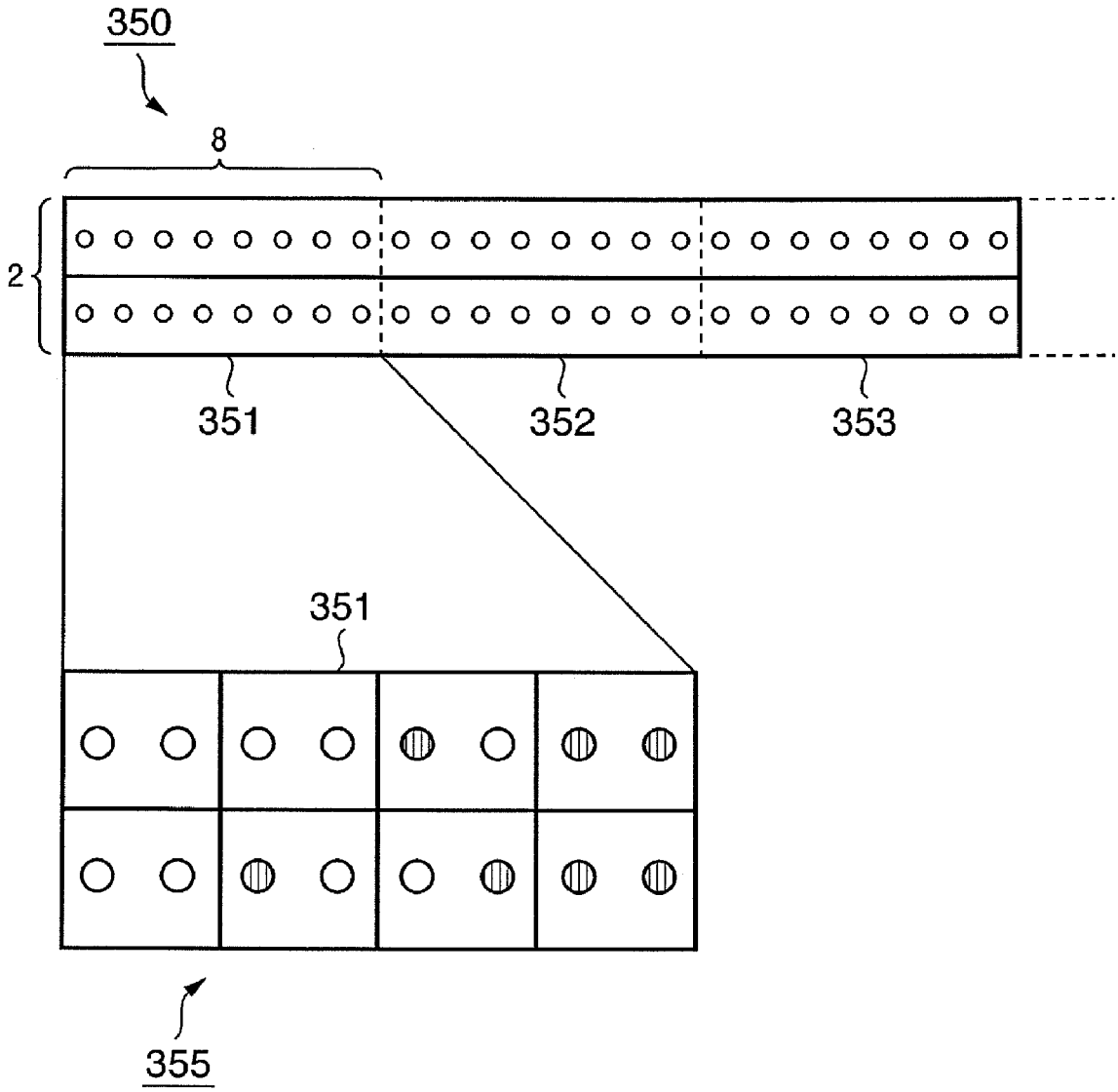
FIG. 3E is a diagram for describing a state in which rows of printhead nozzles have been divided into a plurality of blocks.
Figure 4A:
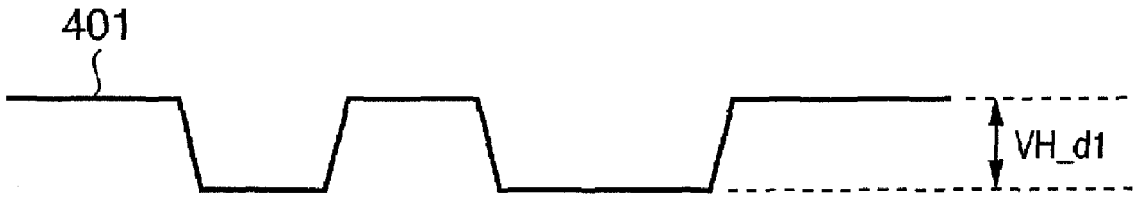
FIGS. 4A and 4B are diagrams illustrating voltage drops ascribable to number of printing elements driven simultaneously.
Figure 4B:
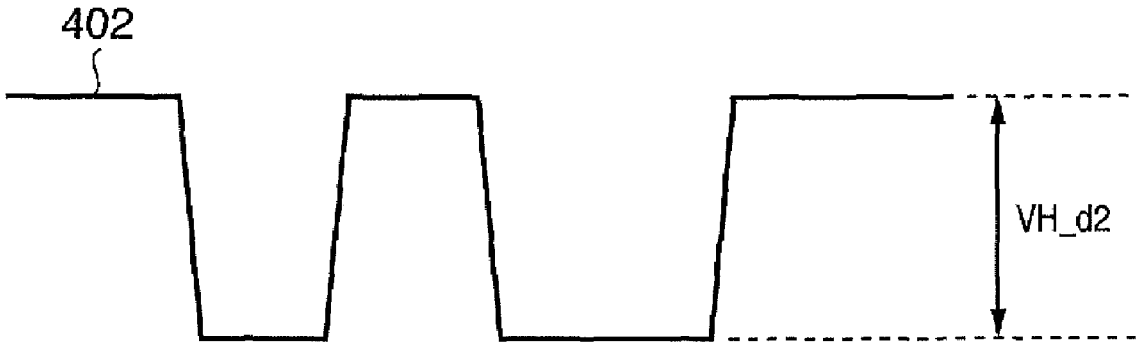

In FIG. 3E, reference numeral 350 exemplifies rows of nozzles of a printhead divided into a plurality of blocks (351, 352, 353, . . . ), and reference numeral 355 illustrates a state in which nozzles that correspond to simultaneously driven printing elements in one block 351 are indicated by hatching. A plurality of printing elements are divided into a plurality of blocks each of which includes a prescribed number of printing elements. Print data that has been transmitted from the print data generating circuit 304 and driving pulses that have been obtained by processing, described later, in first measurement circuit 305 to a pulse generating circuit 310 are input to the printhead 1 in an ink discharge period that conforms to the resolution of the image to be printed. (The period can be obtained in accordance with the print trigger signal mentioned above.) The printing elements of the plurality of blocks are driven sequentially to discharge the ink.

Based upon the value of the count (referred to as "count value A") of simultaneously printed dots counted by the first measurement circuit 305, the first measurement circuit 305 consults a pulse table 311, which has been prepared in the control circuit 24 as a data table, and reads out pulse data for driving the nozzles of the printhead 1 (S304). It should be noted that the pulse table 311 can also be stored in the DRAM 23 rather than be provided in the control circuit 24.

Next, a first comparison circuit 306 compares the count value A of number of simultaneously printed dots, which has been counted by the first measurement circuit 305, and a reference threshold N (S305). Here the reference threshold N is data being held in a register within the first comparison circuit 306 and is rewritable by the CPU 21.

If the result of comparing the count value A of number of simultaneously printed dots with the reference threshold N in the first comparison circuit 306 is that count value N=reference threshold N holds ("YES" at S305), control proceeds to step S306 of FIG. 3B. Here a second measurement circuit 307 increments (counts up) a count value CT of a counter in the circuit by +1 and inputs the value of the counter to a second comparison circuit 308. The counter value CT is a value indicating that the number of dots printed simultaneously has exceeded N.

The second comparison circuit 308 compares the count value C, which has entered from the second measurement circuit 307, and a reference threshold M held in the second comparison circuit (S310). The reference threshold M is data held in a register within the second comparison circuit 308 and is rewritable by the CPU 21. The determination made at step S310 is for discriminating a case where printing in which the number of dots printed simultaneously has exceeded N has been performed M or more times in succession.

If the result of comparing the count value CT and reference threshold M in the second comparison circuit 308 is that count value CT=reference threshold M holds ("YES" at step S310), i.e., if printing in which the number of dots printed simultaneously has exceeded N has been performed M or more times in succession then control proceeds to step S311 in FIG. 3B. Here an arithmetic circuit 309 adds a correction value to basic pulse data that has been read out at the preceding step S304 by the first measurement circuit 305 (S311) and inputs the resultant correction pulse data, to which the correction value has been added, to the pulse generating circuit 310.

Figure 5A:
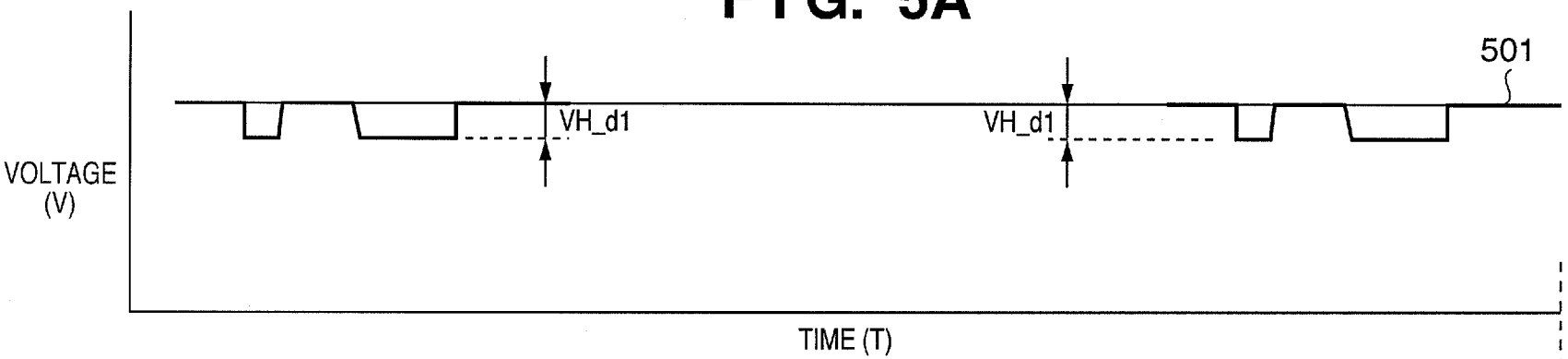
FIGS. 5A and 5B are diagrams illustrating transitions in voltage drop due to continuous printing.
Figure 5B:
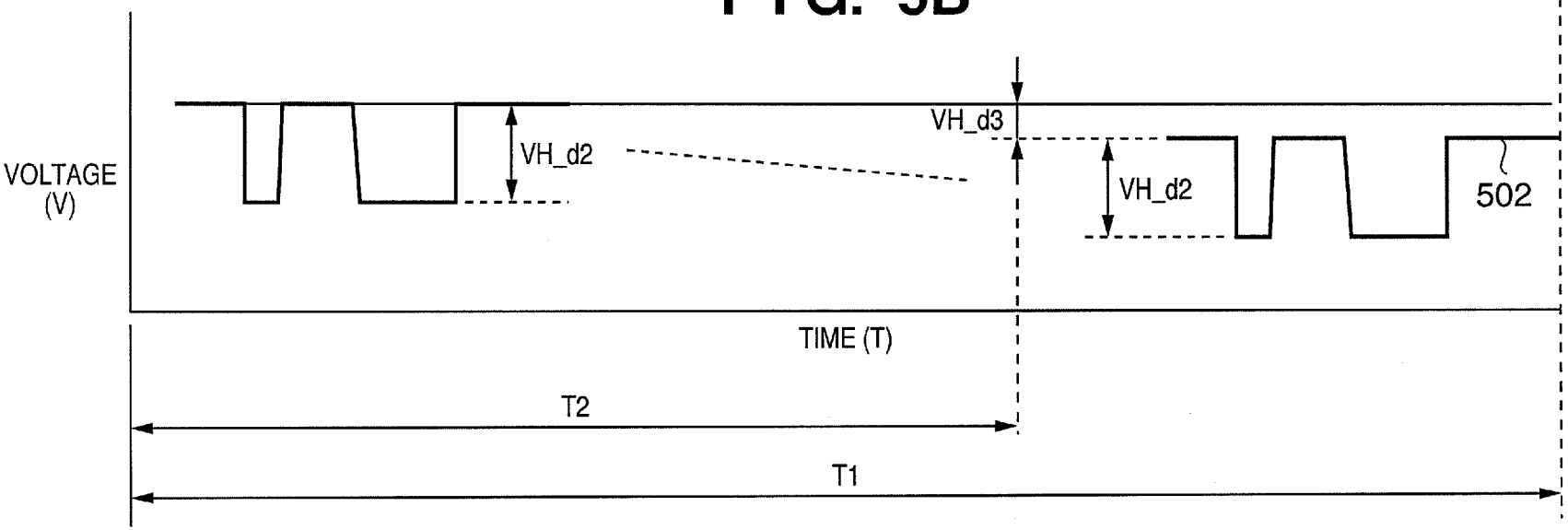

The correction value added to the basic pulse data in the arithmetic circuit 309 is data held in a register within the arithmetic circuit 309 and is rewritable by the CPU 21. By adding the correction value to the pulse data, the arithmetic circuit 309 is capable of calculating correction pulse data that has taken into account the amount of a voltage drop (e.g., VH_d3 described in FIG. 5B) caused by continuous printing.

On the basis of the correction pulse data to which the correction value has been added, the pulse generating circuit 310 generates corrected driving pulses for driving the printhead 1 (see 330 in FIG. 3C) and outputs these pulses to the head driver 25 to drive the printhead 1 by the corrected driving pulses the pulse width whereof has been corrected (S313).

In FIG. 3C, driving pulses (of pulse width P1) 320 are based upon the pulse data prior to correction, and corrected driving pulses (of pulse width P2) 330 are generated based upon the corrected pulse data. The pulse width P2 of the corrected driving pulses is the result of correcting the pulse width P1 of the driving pulses prior to correction by a pulse width equivalent to P3 (i.e., the pulse width P2 is obtained by adding the pulse width P3 to the pulse width P1). This correction makes it possible to compensate for the voltage drop due to continuous printing.

If the decision rendered at step S310 is that count value CT<reference threshold M holds ("NO" at step S310), the arithmetic circuit 309 does not add the correction value to the pulse data obtained by referring to the pulse table 311 (S312) and inputs only the basic pulse data to the pulse generating circuit 310. At this time the pulse generating circuit 310 generates the driving pulses for driving the printhead 1 based upon the pulse data to which a correction value has not been added (e.g., see 320 in FIG. 3C) and outputs these driving pulses to the head driver 25 to control driving of the printhead 1 (S313).

The correction value added to the pulse data in the arithmetic circuit 309 is data held in a register within the arithmetic circuit 309. It is assumed that the register can store a plurality of correction values because of the relationship with the count value CT. FIG. 3D illustrates the state in which correction values 1, 2, 3 corresponding to respective ones of count values CT1, CT2, CT3, . . . have been stored in the register. The count values CT1, CT2, CT3, . . . and correction values 1, 2, 3 are rewritable by the CPU. It is assumed that the arithmetic circuit 309 is capable of selecting from the register a correction value (i=1, 2, 3, . . . ) conforming to a count value CT (i=1, 2, 3, . . . ).

As a result, a voltage drop that fluctuates in dependence upon the number of times continuous drive is performed can be corrected for appropriately.

Thus, a printing apparatus for printing by causing a carriage, on which is mounted a printhead having a plurality of printing elements, to scan across a printing medium is such that the plurality of printing elements are divided into a plurality of blocks (e.g., see FIG. 3E) based upon entered printed data, the apparatus comprising: a first measurement circuit for counting the number of printing elements driven simultaneously in the blocks; a first comparison circuit for performing a comparison to determine whether the number of printing elements counted by the first measurement circuit exceeds a reference threshold (e.g., N at step S305 in FIG. 3B) of the number of printing elements; a second measurement circuit for measuring number (CT) of cycles of simultaneous drive in which the number of printing elements driven simultaneously has exceeded the reference threshold of the number of printing elements based upon the comparison performed by the first comparison circuit; and a pulse generating circuit which, if the number of cycles of simultaneous drive has exceeded a reference threshold of number of drive cycles, is for adding reference pulse data and correction pulse data to generate driving pulses (e.g., 330 shown in FIG. 3C) of corrected pulse width.

On the other hand, if the decision rendered at step S305 is that count value A of number of simultaneously printed dots <reference threshold N holds ("NO" at S305), control proceeds to step S307. Here the second measurement circuit 307 compares the count value CT of the counter with zero. If count value CT=0 holds ("YES" at S307), control proceeds to step S308, where the second measurement circuit 307 stores the count value CT as zero (S308). On the other hand, if count value ≠0 holds ("NO" at S307), then control proceeds to step S309, where the count value CT of the counter presently set is decremented (counted down) by −1 (S309). If the count value A of number of simultaneously printed dots does not reach the prescribed reference threshold N, then the count value is set upon reducing the count value (CT) used as the criterion of continuous printing.

The second comparison circuit 308 compares the count value CT, which has been set in the register within the second comparison circuit 308, with the reference threshold M (S310) and, in accordance with the result of the comparison the arithmetic circuit 309 determines whether or not to add on the correction value.

Thus, in accordance with this embodiment of the present invention, as described above, if printing in which the number of simultaneously printed dots (the number of printing elements that print simultaneously) exceeds N continues for M times or more, a correction value is added to basic pulse data, thereby generating corrected driving pulses that take into account the amount of a voltage drop ascribable to continuous printing and controlling drive of the printing elements. As a result, it is possible to print an excellent image not influenced by a voltage drop caused by continuous printing.

Alternatively, in accordance with this embodiment of the present invention, if the number of simultaneously driven printing elements requiring a large current continue printing, more accurate control of drive of the printing elements becomes possible by predicting the voltage drop that will occur and correcting the driving pulse width.

OTHER EMBODIMENTS

It goes without saying that the object of the invention is attained also by supplying a storage medium storing the program codes of the software for performing the functions of the foregoing embodiment to a system or an apparatus, reading the program codes with a computer (e.g., a CPU or MPU) of the system or apparatus from the storage medium, and then executing the program codes.

In this case, the program codes per se read from the storage medium implement the functions of the embodiment and the storage medium storing the program codes constitutes the invention.

Examples of storage media that can be used for supplying the program code are a flexible disk, hard disk, optical disk, magneto-optical disk, CD-ROM, CD-R, magnetic tape, non-volatile type memory card or ROM, etc.

Furthermore, besides the case where the aforesaid functions according to the embodiment are implemented by executing the program codes read by a computer, it goes without saying that the present invention covers a case where an operating system or the like running on the computer performs a part of or the entire process in accordance with the designation of program codes and implements the functions according to the embodiment.

It goes without saying that the present invention further covers a case where, after the program codes read from the storage medium are written in a memory provided on a function expansion board inserted into the computer or in a function expansion unit connected to the computer, a CPU or the like contained in the function expansion board or function expansion unit performs a part of or the entire process in accordance with the designation of program codes and implements the function of the above embodiment.

As many apparently widely different embodiments of the present invention can be made without departing from the spirit and scope thereof, it is to be understood that the invention is not limited to the specific embodiments thereof except as defined in the appended claims.

This application claims the benefit of Japanese Patent Application No. 2005-051371 filed on Feb. 25, 2005, which is hereby incorporated by reference herein its entirety.

What is claimed is:

1. A printing apparatus for printing by causing a carriage, on which is mounted a printhead having a plurality of printing elements, to scan across a printing medium, the plurality of printing elements being divided into a plurality of blocks based upon entered print data, said apparatus comprising:

first comparison means for performing a comparison to determine whether a number of printing elements driven simultaneously in the blocks exceeds a first reference threshold;

second comparison means for performing a comparison to determine whether a number of times continuous drive of the simultaneously driven printing elements has been performed exceeds a second reference threshold of a number of times such drive is performed; and generating means which if a result of comparison by said first comparison means exceeds the first reference threshold and a result of comparison by said second comparison means exceeds the second reference threshold, is for adding reference pulse data and corrected pulse data to thereby generate driving pulses of corrected pulse width, wherein on a basis of the result of the comparison by said first comparison means to the effect that the first reference threshold has been exceeded, said second comparison means performs a comparison to determine whether the number of times continuous drive of the simultaneously driven printing elements has been performed exceeds the second reference threshold.

2. The apparatus according to claim 1, further comprising:

first counting means for counting the number of printing elements driven simultaneously; and second counting means for counting the number of times continuous drive of the simultaneously driven printing elements has been performed.

3. The apparatus according to claim 2, wherein if the number of times simultaneous drive has been performed counted by said second counting means does not exceed the second reference threshold, said generating means generates the driving pulses based upon the reference pulse data.

4. The apparatus according to claim 1, wherein said generating means generates the driving pulses by selecting different correction pulses in accordance with the number of times continuous drive of the simultaneously driven printing elements has been performed exceeds the second reference threshold.

5. The apparatus according to claim 2, wherein said second counting means counts up the number of times simultaneous drive has been performed if the number of simultaneously driven printing elements exceeds the first reference threshold, and counts down the number of times simultaneous drive has been performed if the number of simultaneously driven printing elements does not exceed the first reference threshold.

6. A method of controlling printing in a printing apparatus for printing by causing a carriage, on which is mounted a printhead having a plurality of printing elements, to scan across a printing medium, the plurality of printing elements being divided into a plurality of blocks based upon entered print data, said method comprising:

a first comparison step of performing a comparison to determine whether a number of printing elements driven simultaneously in the blocks exceeds a first reference threshold;

a second comparison step of performing a comparison to determine whether a number of times continuous drive of the simultaneously driven printing elements has been performed exceeds a second reference threshold of a number of times such drive is performed; and a generating step of adding reference pulse data and corrected pulse data to thereby generate driving pulses of corrected pulse width if a result of comparison at said first comparison step exceeds the first reference threshold and a result of comparison at said second comparison step exceeds the second reference threshold, wherein on a basis of the result of the comparison at said first comparison step to the effect that the first reference threshold has been exceeded, said second comparison step performs a comparison to determine whether the number of times continuous drive of the simultaneously driven printing elements has been performed exceeds the second reference threshold.

7. A printing control program which is embodied on a computer-readable medium and is executed by a computer that controls a printing apparatus for printing by causing a carriage, on which is mounted a printhead having a plurality of printing elements, to scan across a printing medium, the plurality of printing elements being divided into a plurality of blocks based upon entered print data, said program comprising:

a first comparison step of performing a comparison to determine whether a number of printing elements driven simultaneously in the blocks exceeds a first reference threshold;

a second comparison step of performing a comparison to determine whether a number of times continuous drive of the simultaneously driven printing elements has been performed exceeds a second reference threshold of a number of times such drive is performed; and a generating step of adding reference pulse data and corrected pulse data to thereby generate driving pulses of corrected pulse width if a result of comparison at said first comparison step exceeds the first reference threshold and a result of comparison at said second comparison step exceeds the second reference threshold, wherein on a basis of the result of the comparison at said first comparison step to the effect that the first reference threshold has been exceeded, said second comparison step performs a comparison to determine whether the number of times continuous drive of the simultaneously driven printing elements has been performed exceeds the second reference threshold.

8. A computer-readable storage medium storing a printing control program executable by a computer that controls a printing apparatus for printing by causing a carriage, on which is mounted a printhead having a plurality of printing elements, to scan across a printing medium, the plurality of printing elements being divided into a plurality of blocks based upon entered print data, said storage medium having:

code of a first comparison step of performing a comparison to determine whether a number of printing elements driven simultaneously in the blocks exceeds a first reference threshold;

code of a second comparison step of performing a comparison to determine whether a number of times continuous drive of the simultaneously driven printing elements has been performed exceeds a second reference threshold of a number of times such drive is performed; and code of a generating step of adding reference pulse data and coffected pulse data to thereby generate driving pulses of coffected pulse width if a result of comparison at said first comparison step exceeds the first reference threshold and a result of comparison at said second comparison step exceeds the second reference threshold, wherein on a basis of the result of the comparison at said first comparison step to the effect that the first reference threshold has been exceeded, said second comparison step performs a comparison to determine whether the number of times continuous drive of the simultaneously driven printing elements has been performed exceeds the second reference threshold.

* * * * *

UNITED STATES PATENT AND TRADEMARK OFFICE

CERTIFICATE OF CORRECTION

PATENT NO. : 7,401,882 B2
APPLICATION NO. : 11/276194
DATED : July 22, 2008
INVENTOR(S) : Umezawa It is certified that error appears in the above-identified patent and that said Letters Patent is hereby corrected as shown below:

COLUMN 1:
Line 30, “using” should be deleted.

COLUMN 9:
Line 42, “herein” should read --herein in--.

COLUMN 12:
Line 14, “coffected” should read --corrected--.
Line 15, “coffected” should read --corrected--.

Signed and Sealed this

Third Day of March, 2009

JOHN DOLL
*Acting Director of the United States Patent and Trademark Office*